US009186670B2

(12) United States Patent
Berthier et al.

(10) Patent No.: US 9,186,670 B2
(45) Date of Patent: Nov. 17, 2015

(54) FUNCTIONALIZED MICROFLUIDIC DEVICE AND METHOD

(75) Inventors: Erwin Berthier, Madison, WI (US); Eric Sackmann, Madison, WI (US); Peter Cavnar, Madison, WI (US); David Beebe, Monona, WI (US); David John Guckenberger, Oconomowoc, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 159 days.

(21) Appl. No.: 13/467,544

(22) Filed: May 9, 2012

(65) Prior Publication Data

US 2013/0302817 A1 Nov. 14, 2013

(51) Int. Cl.
*B01L 3/00* (2006.01)

(52) U.S. Cl.
CPC ..... *B01L 3/502715* (2013.01); *B01L 3/50853* (2013.01); *B01L 3/5023* (2013.01); *B01L 2200/027* (2013.01); *B01L 2300/044* (2013.01); *B01L 2300/047* (2013.01); *B01L 2300/0672* (2013.01); *B01L 2300/0816* (2013.01); *B01L 2400/0406* (2013.01); *B01L 2400/0481* (2013.01); *B01L 2400/0677* (2013.01); *B01L 2400/0683* (2013.01); *B01L 2400/086* (2013.01)

(58) Field of Classification Search
None
See application file for complete search history.

(56) References Cited

U.S. PATENT DOCUMENTS

2007/0292941 A1 * 12/2007 Handique et al. ..... 435/288.7
2009/0185955 A1 * 7/2009 Nellissen ..... 422/68.1

FOREIGN PATENT DOCUMENTS

WO WO 2010111265 A1 * 9/2010 ..... H01L 23/48
WO WO 2010149292 A1 * 12/2010 ..... B01L 3/00

OTHER PUBLICATIONS

"SlipChip", Wenbin Du et al, Lab Chip, 2009, 9, 2286-2292.

* cited by examiner

*Primary Examiner* — Galina Yakovleva
*Assistant Examiner* — Andrea S Grossman
(74) *Attorney, Agent, or Firm* — Boyle Fredrickson, S.C.

(57) ABSTRACT

A microfluidic device and method is provided for handheld diagnostics and assays. The device includes a base having outer surface and a channel therethough for receiving fluid therein. The channel has input and output ports communicating with the outer surface. A lid is also provided. The lid has an outer surface, a first well having a port communicating with the outer surface of the lid, and a second well having a port communicating with the outer surface. The lid moveable between a first disengaged position and a second engaged position wherein the first port of the lid is adjacent the input port of the channel and the second port is adjacent the output port of the channel.

12 Claims, 6 Drawing Sheets

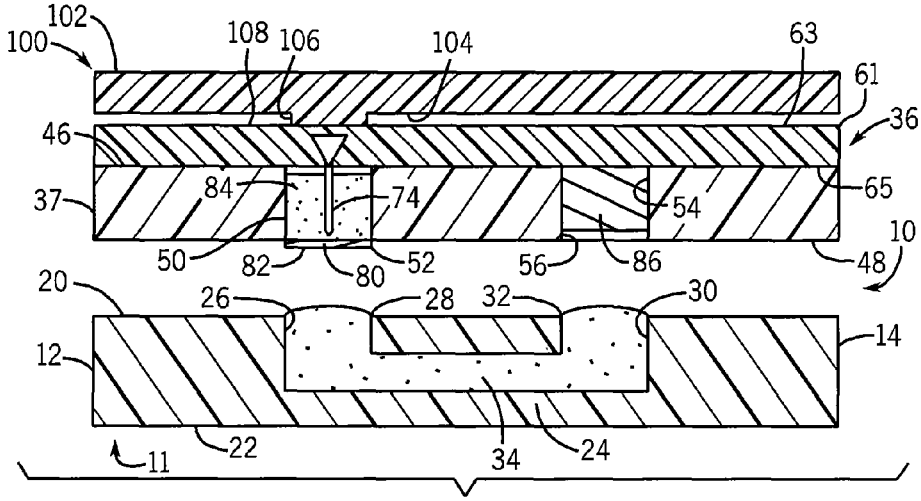
FIG. 2
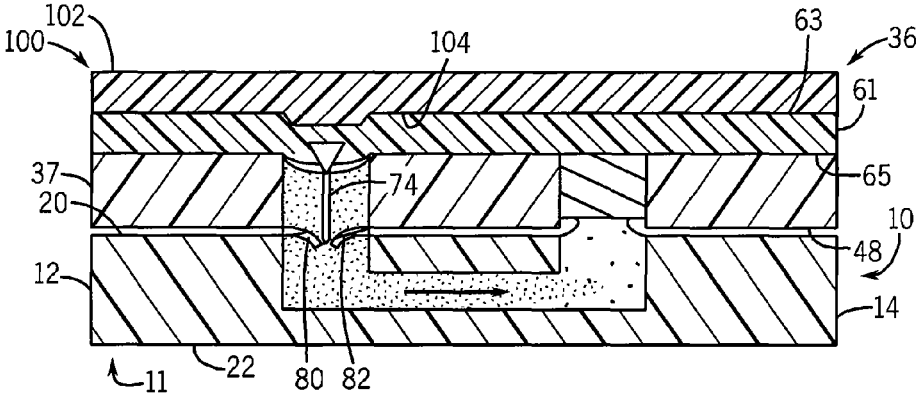
FIG. 3
FIG. 3a
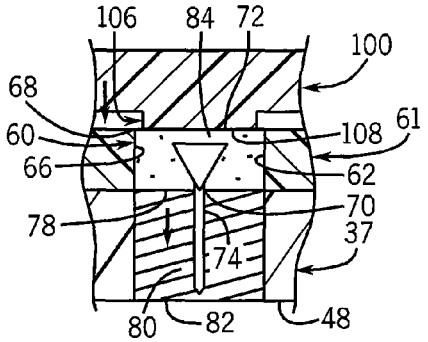

FUNCTIONALIZED MICROFLUIDIC DEVICE AND METHOD

REFERENCE TO GOVERNMENT GRANT

This invention was made with government support under CA137673 awarded by the National Institutes of Health. The government has certain rights in the invention.

FIELD OF THE INVENTION

This invention relates generally to microfluidic devices, and in particular, to a functionalized microfluidic device and method for handheld diagnostics, as well as, biological and chemical assays.

BACKGROUND AND SUMMARY OF THE INVENTION

The field of microfluidics has matured significantly over the past two decades. Compelling platforms have been produced to address problems in traditional cell biology techniques that were previously too difficult to solve. Limitations of traditional cell biology techniques have been primarily due to onerous labor requirements and limited spatial and temporal control of the cells' microenvironment. Microfluidics has provided significant efficiency gains by reducing reagent and cell requirements that, in turn, has allowed for high-throughput processing and analysis of a large array of experimental conditions. Microfluidic systems also offer significantly greater control of the cells' microenviroment, such as flow rate, extracellular matrix (ECM) properties, and soluble factor signaling (e.g., forming a chemical gradient in diffusion dominant conditions). However, for microfluidics to make further inroads into cell biology, new microfluidic assays must be cheaper, faster, and in qualitative agreement with techniques traditionally used by biologists. It can be appreciated that microfluidics has tremendous potential to contribute to the development of drug therapies to fight cancer, point-of-care diagnostics for HIV in developing countries, and numerous other applications that are critical to the health and well being of individuals worldwide.

While current microfluidic devices provide a significant improvement in the ability to study fundamental aspects of cell biology, the adoption of microfluidic devices in clinical settings has been slow due to the high level of technicality and external equipment required. For example, current microfluidic assay methods require steps such as washing, flushing, pipetting, and transferring of cells and other materials. As such, most conventional microfluidic devices typically incorporate external elements, such as tubing and syringe pumps, to provide the valving and the mixing functionality necessary to enable an entire assay to be performed within a microfluidic system. These external elements diminish the simplicity and advantages of a microfluidic platform for biological assays. Hence, it is highly desirable to provide a handheld, disposable microfluidic device capable of performing assays which does not require any external equipment to operate and which can be adapted to a wide range of situations.

Therefore, it is a primary object and feature of the present invention to provide a microfluidic device and a method for performing handheld diagnostics and assays which do not require any external equipment to operate and which can be adapted to a wide range of situations.

It is a further object and feature of the present invention to provide a microfluidic device and a method for performing diagnostics and assays, which are handheld and disposable.

It is a still further object and feature of the present invention to provide a microfluidic device and a method for performing handheld diagnostics and assays which are simple to use and inexpensive to manufacture.

In accordance with the present invention, a microfluidic device is provided for handheld diagnostics and assays. The microfluidic device includes a base having outer surface and a channel therethough for receiving fluid therein. The channel has input and output ports communicating with the outer surface. The microfluidic device also includes a lid having an outer surface, a first well having a port communicating with the outer surface of the lid, and a second well having a port communicating with the outer surface. The lid is moveable between a first disengaged position and a second engaged position wherein the first port of the lid is adjacent the input port of the channel and the second port is adjacent the output port of the channel.

A membrane may extend over the input port of the lid and a piercing element may be operatively connected to the lid. The piercing element is moveable between a first retracted position and a second extended position wherein the piercing element pieces the membrane. The piercing element may include a plunger receivable in the lid and a needle extending from the plunger. The plunger is moveable between a first retracted position and a second extended position wherein the needle pierces the membrane. The needle has a terminal end and is moveable from a first retracted position wherein the terminal end of the needle is received in the first well in the lid and a second extended position wherein the terminal end of the needle projects from the lid in response to the movement of the plunger from the first retracted position and the second extended position.

A fluid absorbent may be received in the second well of the lid to communicate with fluid in the channel of the base with the lid in the engaged position. It is further contemplated for a substance source to be receivable in the first well of the lid. The substance source includes substance for diffusing into fluid in the channel of the base with the lid in the engaged position. The substance source may include a porous media to house the substance.

In accordance with a further aspect of the present invention, a microfluidic device is provided for handheld diagnostics and assays. The microfluidic device includes a base having outer surface and a channel therethough for receiving fluid therein. The channel has input and output ports communicating with the outer surface. A lid has an outer surface and is connectable to base. The lid includes a first well having an interior and a port communicating with the outer surface of the lid and a second well having a port communicating with the outer surface. A membrane extends over the port of the first well for isolating the interior thereof. The lid is moveable between a first disconnected position and a second connected position wherein the first port of the lid is adjacent the input port of the channel and the second port is adjacent the output port of the channel.

The membrane may be removable or, alternatively, a piercing element may be operatively connected to the lid. The piercing element is moveable between a first retracted position and a second extended position wherein the piercing element pieces the membrane. The piercing element may include a plunger receivable in the lid and a needle extending from the plunger. The plunger is moveable between a first retracted position and a second extended position wherein the needle pierces the membrane. The needle has a terminal end and is moveable from a first retracted wherein the terminal end of the needle is received in the first well in the lid and a second extended position wherein the terminal end of the needle projects from the lid in response to the movement of the plunger from the first retracted position and the second extended position.

A fluid absorbent may be receivable in the second well of the lid so as to communicate with fluid in the channel of the base with the lid in the connected position. In addition, it is contemplated to provide a substance source in the first well of the lid. The substance source includes substance for diffusing into fluid in the channel of the base with the lid in the connected position. The substance source may include a porous media to house the substance.

In accordance with a still further aspect of the present invention, a method is provided for handheld diagnostics and assays. The method includes the steps of providing a channel having an input and an output and positioning a lid having first and second wells adjacent the channel. The first well has a predetermined substance therein. Thereafter, the first well is allowed to communicate with the input of the channel.

A membrane may be provided over the first well. The step of allowing the first well to communicate with the input of the channel may include the additional step of piercing the membrane. It is contemplated to draw the predetermined substance into the channel, e.g., by bringing an absorbent into contact with the output of the channel. The predetermined substance may include particles for diffusing into fluid in the channel and a porous media to house the particles.

BRIEF DESCRIPTION OF THE DRAWINGS

The drawings furnished herewith illustrate a preferred construction of the present invention in which the above advantages and features are clearly disclosed as well as other which will be readily understood from the following description of the illustrated embodiment.

In the drawings:

FIG. 2 is a cross sectional view of the microfluidic device of FIG. 1 in a non-actuated position;

FIG. 3 is a cross sectional view of the microfluidic device of FIG. 2 in an actuated position;

FIG. 3*a* is an enlarged, cross sectional view of the microfluidic device, similar to FIG. 2, showing an alternate actuation mechanism;

DETAILED DESCRIPTION OF THE DRAWINGS

Figure 1:
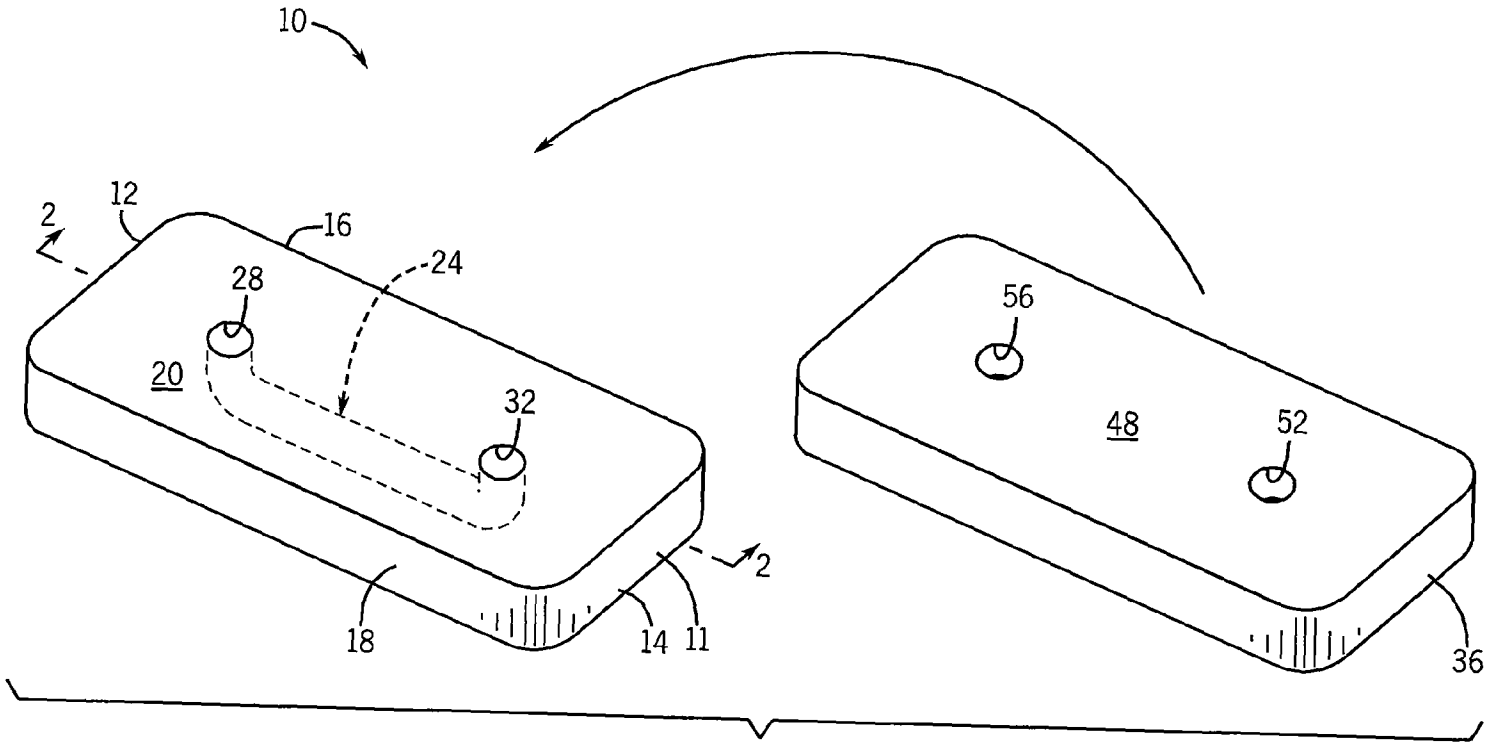
FIG. 1 is an exploded, isometric view of a microfluidic device in accordance with the present invention.

Referring to FIGS. 1-3, a microfluidic device in accordance with the present invention is generally designated by the reference numeral 10. Microfluidic device 10 may be formed from polystyrene (PS) or polydimethylsiloxane (PDMS), however, other materials are contemplated as being within the scope of the present invention. In the depicted embodiment, microfluidic device 10 includes base 11 having first and second ends 12 and 14, respectively; first and second sides 16 and 18, respectively; and upper and lower surfaces 20 and 22, respectively. Channel 24 extends through base 11 of microfluidic device 10 and includes a first vertical portion 26 terminating at an input port 28 that communicates with upper surface 20 of base 11 of microfluidic device 10 and a second vertical portion 30 terminating at an output port 32 also communicating with upper surface 20 of base 11 of microfluidic device 10. First and second vertical portions 26 and 30, respectively, of channel 24 are interconnected by and communicate with horizontal portion 34 of channel 24. The dimension of channel 34 connecting input port 28 and output port 32 is arbitrary.

Microfluidic device 10 further includes lid 36 having a first layer 37 with first and second ends; first and second sides; and upper and lower surfaces 46 and 48, respectively. Similar to base 11, first layer 37 may be formed from polystyrene (PS), however, other materials are contemplated as being within the scope of the present invention. First layer 37 of lid 36 further includes a first well 50 terminating at an output port 52 that communicates with lower surface 48 and a second well 54 terminating at an input port 56 communicating with lower surface 48. The diameter of output port 52 is generally equal to the diameter of input port 28 in base 11 and the diameter of input port 56 is generally equal to the diameter of output port 32 of base 11.

As best seen in FIGS. 2-3, it is contemplated to provide for lid 36 to further include a second layer 61 having an upper surface 63 and a lower surface 65 affixed to upper surface 46 of first layer 37. Second layer 61 further includes first and second ends aligned with correspond first and second ends of first layer 37; and first and second sides aligned with first and second sides of first layer 37. Second layer 61 may be formed from a flexible material, e.g., polydimethylsiloxane (PDMS), and includes needle 74 projecting from lower surface 65 thereof. Needle 74 terminates at terminal end 80 which is receivable in first well 50.

To facilitate actuation of device 10, lid 36 may include an enlarged cap 100 having first and second ends aligned with correspond first and second ends of first layer 37; first and second sides aligned with first and second sides of first layer 37; and upper and lower surfaces 102 and 104, respectively. Similar to base 11 and first layer 37, end cap 100 may be formed from polystyrene (PS), however, other materials are contemplated as being within the scope of the present invention. Actuation post 106 projects from lower surface 104 of end cap 100 and is axially aligned with first well 50 in first layer 37. It is intended for terminal end 108 of actuation post 106 to engage upper surface 67 of second layer 61. As described, end cap 100 is movable between a first non-actuated position wherein terminal end 80 of needle 74 is received in first well 50, FIG. 2, and a second, actuated position wherein terminal end 108 of actuation post 106 urges a plunger portion of second layer 61 downwardly in FIG. 3 such that terminal end 80 of needle 74 projects from first well 50.

Alternatively, FIG. 3*a*, second layer 61 may include passage 62 therethrough which is adapted for slideably receiving plunger 60 therein. By way of example, passage 62 has a generally cylindrical configuration having defined by wall 66. Wall 66 has an upper edge 68 which communicates with upper surface 63 of second layer 61 and a lower end 70 defining an opening which communicates with first well 50. Plunger 60 is defined by upper surface 72 and lower surface 78 interconnected by generally cylindrically outer surface 76 which forms a slidable interface with wall 66. Needle 74 projects from lower surface 78 of plunger 60. It is contemplated for plunger 60 to be movable between a first, unactuated position wherein upper surface 72 of plunger 60 is generally coplanar with upper surface 46 of lid 36 and terminal end 80 of needle 74 is received in first well 50 and a second, actuated position wherein upper surface 72 of plunger 60 is received in passage 62 and terminal end 80 of needle 74 projects from first well 50.

It can be appreciated that end cap 100 may be used to move plunger 60 between its unactuated and actuated positions. More specifically, end cap 100 may be positioned such that terminal end 108 of actuation post 106 engages upper surface 72 of plunger 60. In operation, as end cap 100 moves from its first non-actuated position to its actuated position, terminal end 108 of actuation post 106 urges plunger 60 downwardly such that terminal end 80 of needle 74 projects from first well 50.

In operation, it is contemplated to utilize microfluidic device 10 to perform a series of steps of a desired assay. More specifically, first well 50 in first layer 37 of lid 36 is loaded with a desired substance 84 such as a reagent or sample fluid and second well 54 is loaded with an absorbent 86. Membrane 82 overlaps the opening to first well 50 in first layer 37 of lid 36 and is bonded to lower surface 48 thereof to retain substance 84 in first well 50. In can be appreciated that by sealing the substance 84 in first well 50 with membrane 82, substance 84 may be pre-loaded in lid 36 for better packaging, storage and shipping.

In order to flow substance 84 into channel 24 through base 11 of microfluidic device 10, channel 24 is filled with a predetermined fluid. Lid 36 is positioned on base 11 such that: 1) lower surface 48 of first layer 37 of lid 36 is bought into contact with or adjacent to upper surface 20 of base 11; 2) output port 52 in first layer 37 of lid 36 is aligned with and brought into close proximity with input port 28 in base 11; and 3) input port 56 in first layer 37 of lid 36 is aligned with and brought into close proximity with output port 32 of base 11 such that absorbent 86 in second well 54 contacts the fluid in channel 24 at output port 32. Thereafter, end cap 100 is moved from its non-actuated position to its actuated position, as heretofore described. Referring to FIG. 3, as end cap 100 is moved from its non-actuated position to its actuated position, terminal end 80 of needle 74 is urged downwardly so as to pierce membrane 82 therewith and urge substance 84 from first well 50 into input port 28 of channel 24. It can be understood that as absorbent 86 in second well 54 contacts the predetermined fluid in channel 24 at output port 32, the flow of substance 84 into channel 24 is induced.

Alternatively, in order to induct the flow of substance 84 into channel 24, absorbent 86 in second well 54 may be removed and an input of a capillary (not shown) may be provided in communication with second well 54. The output of the capillary is operatively connected to a pumping mechanism (not shown). As such, as end cap 100 is moved from its non-actuated position to its actuated position, terminal end 80 of needle 74 is urged downwardly so as to pierce membrane 82 therewith and urge substance 84 from first well 50 into input port 28 of channel 24. As substance 84 is urged into channel 24, it can be understood that predetermined fluid in channel 24 will be urged into second well 54. Thereafter, the predetermined fluid in second well 54 initiates the pumping mechanism so as to initiate fluid flow in channel 24.

Once a step of the assay has been completed and entirely of substance 84 in first well 50 of lid 36 flows into channel 24, lid 36 may be removed from base 11 of microfluidic device 10 and discarded. Thereafter, for each step of the assay, a new lid 36 may placed on base 11, as heretofore described, and end cap 100 urged to its actuated position to trigger operation of microfluidic device 10, as heretofore described.

Figure 4:
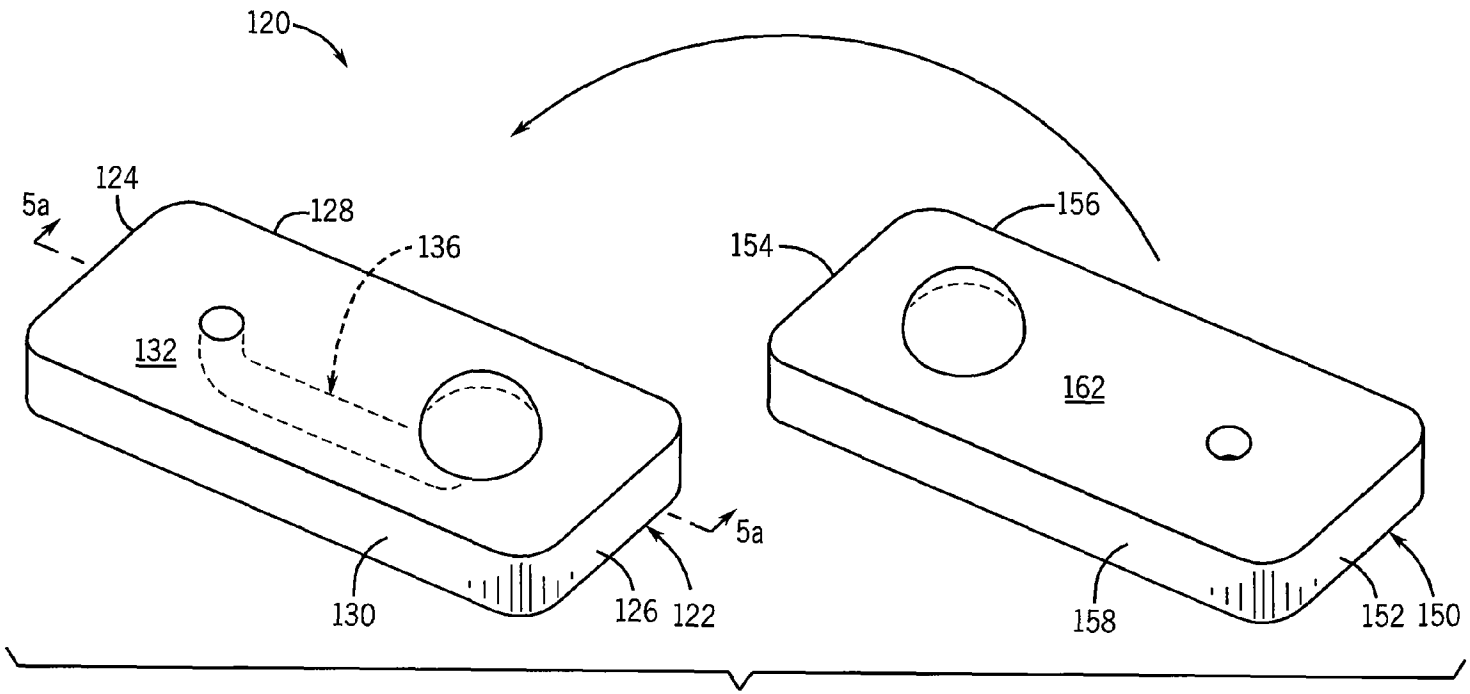
FIG. 4 is an exploded, isometric view of an alternate embodiment of a microfluidic device in accordance with the present invention.
Figure 5A:
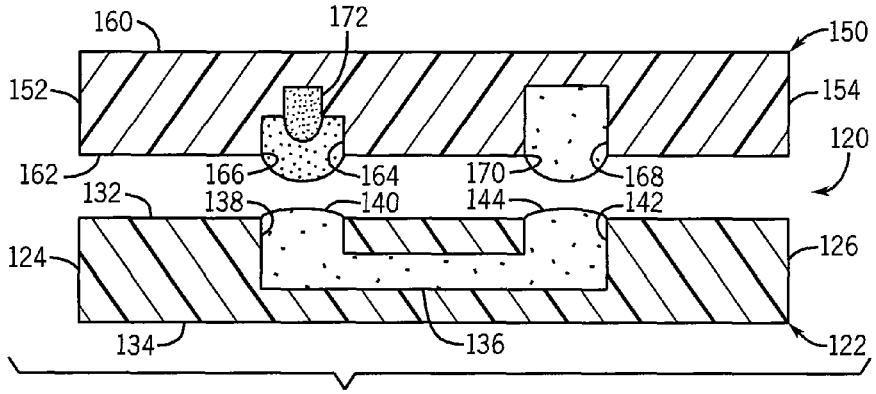
FIG. 5*a* is a cross sectional view of the microfluidic device of FIG. 4 in a non-actuated position.
Figure 5B:
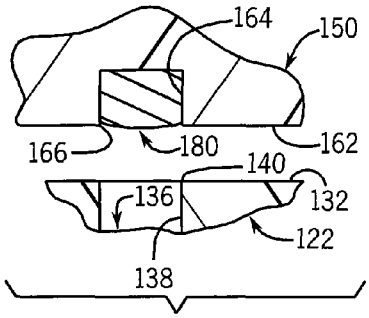
FIG. 5*b* is an enlarged, cross sectional view showing a portion of a first alternate arrangement of the microfluidic device of the present invention in a non-actuated position.
Figure 5C:
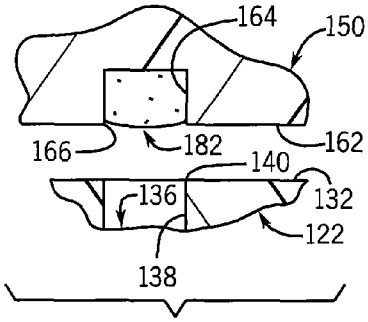
FIG. 5*c* is an enlarged, cross sectional view showing a portion of a second alternate arrangement of the microfluidic device of the present invention in a non-actuated position.
Figure 5D:
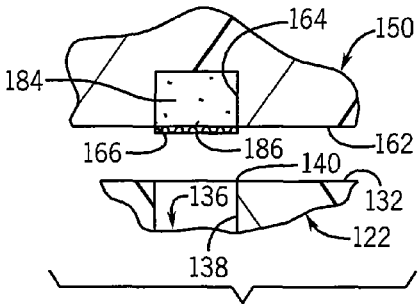
FIG. 5*d* is an enlarged, cross sectional view showing a portion of a third alternate arrangement of the microfluidic device of the present invention in a non-actuated position.
Figure 5E:
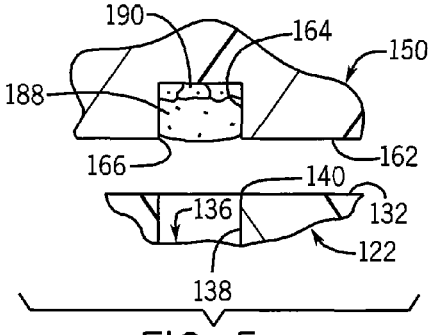
FIG. 5*e* is an enlarged, cross sectional view showing a portion of a fourth alternate arrangement of the microfluidic device of the present invention in a non-actuated position.
Figure 6:
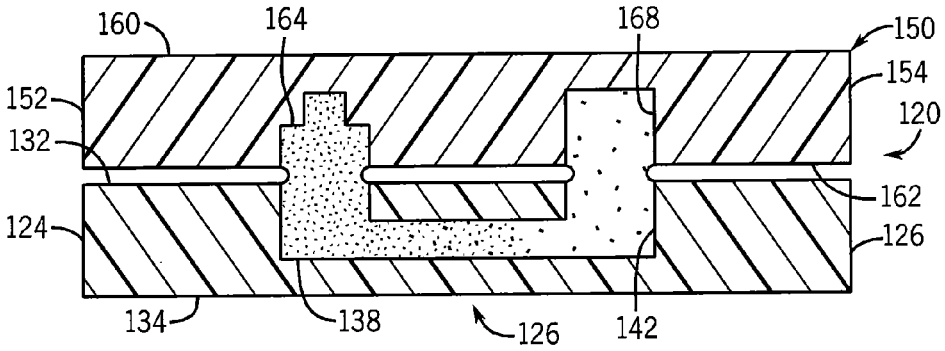
FIG. 6 is a cross sectional view of the microfluidic device of FIG. 5 in an actuated position.
Figure 8:
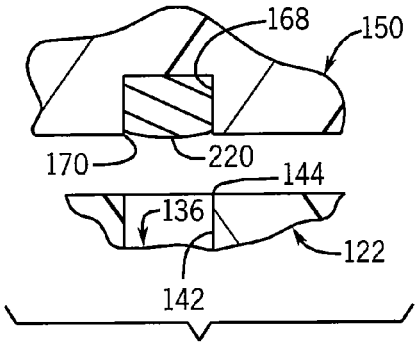
FIG. 8 is an enlarged, cross sectional view showing a portion of a fifth alternate arrangement of the microfluidic device of the present invention in a non-actuated position.

Referring to FIGS. 4-6, an alternate embodiment of a microfluidic device in accordance with the present invention is generally designated by the reference numeral 120. Microfluidic device 120 may be formed from polystyrene (PS), however, other materials are contemplated as being within the scope of the present invention. In the depicted embodiment, microfluidic device 120 includes base 122 having first and second ends 124 and 126, respectively; first and second sides 128 and 130, respectively; and upper and lower surfaces 132 and 134, respectively. Channel 136 extends through base 122 of microfluidic device 120 and includes a first vertical portion 138 terminating at an input port 140 that communicates with upper surface 132 of base 122 of microfluidic device 120 and a second vertical portion 142 terminating at an output port 144 also communicating with upper surface 132 of base 122 of microfluidic device 120. First and second vertical portions 138 and 142, respectively, of channel 136 are interconnected by and communicate with horizontal portion 146 of channel 136. It can be appreciated that the diameter of output port 144 is substantially greater than the diameter of input port 140, for reasons hereinafter described. As best seen in FIG. 8, in an alternate embodiment, it is contemplated for post 145 to project from upper surface 132 of base 122, for reasons hereinafter described.

Microfluidic device 120 further includes lid 150 with first and second ends 152 and 154, respectively; first and second sides 156 and 158, respectively; and upper and lower surfaces 160 and 162, respectively. Similar to base 122, lid 150 may be formed from polystyrene (PS), however, other materials are contemplated as being within the scope of the present invention. Lid 150 further includes a first well 164 terminating at an output port 166 that communicates with lower surface 162 and a second well 168 terminating at an input port 170 communicating with lower surface 162. The diameter of output port 166 is generally equal to the diameter of input port 140 in base 122 and the diameter of input port 170 is generally equal to the diameter of output port 144 in base 122.

As hereinafter described, cells, drugs, chemical treatments and gradients can be applied to channel 136 without flow by leveraging diffusion. More specifically, cells or a desired drug/reagent is mixed with a porous media such as a hydrogel to sequester compounds of interest therein and this "desired substance" is loaded into first well 164 in lid 150, FIG. 5*a*. It is noted that substance 172 may be pre-loaded in first well 164 in lid 150 for better packaging, storage and shipping. For example, substance 172 may be sealed, if desired, in first well 164 of lid 150 in a variety of manners such as by a removable and/or a protective membrane.

Referring to FIG. 6, channel 136 is filled with a predetermined fluid and lid 150 is positioned on base 122 such that: 1) lower surface 162 of lid 150 is bought into contact with or adjacent to upper surface 132 of base 122; 2) output port 166 of lid 150 is aligned with and brought into close proximity with input port 140 in base 122; and 3) input port 170 of lid 150 is aligned with and brought into close proximity with output port 144 of base 122. Once the hydrogel in first well 164 establishes fluid contact with the content of channel 136, the cells or drug/reagent particles in the hydrogel diffuse into the predetermined fluid in channel 136. In the case of drug/reagent particles, after the predetermined time period, a concentration gradient may be created along the length of channel 136 by providing source and sink regions (i.e., input port 140 and output port 144, respectively) with volumes significantly larger that the volume of channel 136. More specifically, the large volume at output port 144 of base 122 helps maintain the concentration gradient in channel 136 by not allowing the particles to accumulate therein. Without a large volume reservoir such as output port 144, the particles diffusing into channel 136 and the concentration gradient in channel 136 would not reach a pseudo-steady state value.

It can be appreciated that microfluidic device 120 of the present invention allows a user to efficiently generate a gradient in a simple straight channel allowing a user to measure the chemotaxis of cells in channel 136 in response thereto. Further, it can be appreciated that a user has the ability to manipulate fluids in channel 136 of base 122 before applying the gradient. Alternatively, by simply removing lid 150 from base 122 and washing the fluid out of channel 136, a user can remove the gradient therefrom, thereby allowing for performance of subsequent operations on a sample in channel 136 of base 122 of microfluidic device 120.

Referring to FIGS. 5*b*-5*c*, alternate embodiments are provided for diffusing a compound into channel 136. More specifically, it is contemplated replace substance 172 with either pad 180 saturated with a diffusive compound, FIG. 5*b*, or viscous fluid 182 loaded with the diffusive compound, FIG. 5*c*. As such, pad 180 or viscous fluid 182 is received in first well 164 of lid 150. Thereafter, lid 150 is positioned on base 122, as heretofore described, such that: 1) lower surface 162 of lid 150 is bought into contact with or adjacent to upper surface 132 of base 122; 2) output port 166 of lid 150 is aligned with and brought into close proximity with input port 140 in base 122; and 3) input port 170 of lid 150 is aligned with and brought into close proximity with output port 144 of base 122. Once pad 180 or viscous fluid 182 in first well 164 establishes fluid contact with the content of channel 136, the diffusive compound in pad 180 or viscous fluid 182 diffuses into the predetermined fluid in channel 136.

Figure 9:
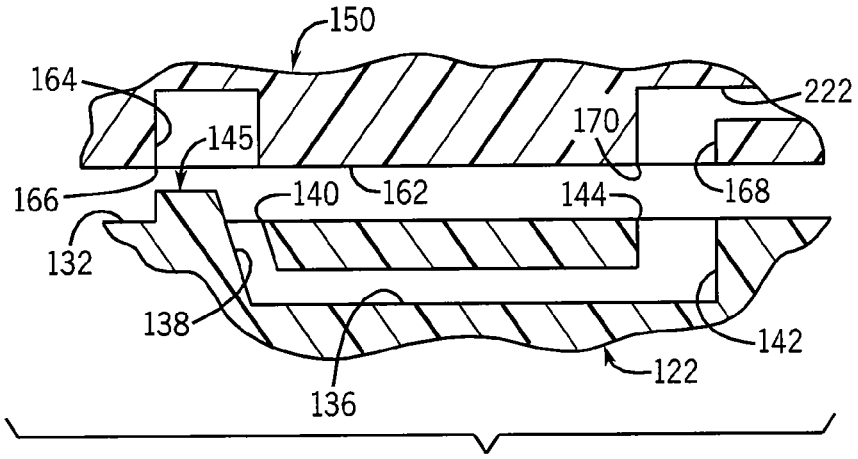
FIG. 9 is an enlarged, cross sectional view showing a portion of a sixth alternate arrangement of the microfluidic device of the present invention in a non-actuated position.

Referring to FIG. 9, in order to urge viscous fluid 182 from first well 164 of lid 150 and into channel 136, post 145 may be provided. As lid 150 is positioned on base 122, it is contemplated for post 145 projecting from upper surface 132 of base 122 to be received into first well 164 through output port 166. It can be appreciated that as post 145 enters first well 164, viscous fluid 182 is urged from first well 164 and into channel 136 through output port 144.

Alternatively, referring to FIG. 5*d*, fluid 184 loaded with the diffusive compound, FIG. 5*c*, may be received in first well 164 of lid 150. Fluid 184 is sealed in first well 164 of lid 150 by porous membrane 186. Thereafter, lid 150 is positioned on base 122, as heretofore described, such that: 1) lower surface 162 of lid 150 is bought into contact with or adjacent to upper surface 132 of base 122; 2) output port 166 of lid 150 is aligned with and brought into close proximity with input port 140 in base 122; and 3) input port 170 of lid 150 is aligned with and brought into close proximity with output port 144 of base 122. Once membrane 186 establishes fluid contact with the content of channel 136, the diffusive compound in fluid 184 diffuses through membrane 186 into the predetermined fluid in channel 136. Again, post 145 may be provided to urge fluid 184 from first well 164 and into channel 136, as heretofore described. Alternatively, membrane 186 may be non-porous and include hole 187 for facilitating the flow of fluid 184 from first well 164 into channel 136 therethough, FIG. 9. As such, post 145 may be provided to engage membrane 186 urge fluid 184 from first well 164 through hole 187 and into channel 136, as heretofore described Referring to FIG. 5*e*, it is further contemplated to provide cell culture media 188 loaded with cells 190 in first well 164 of lid 150. Thereafter, lid 150 is positioned on base 122, as heretofore described, such that: 1) lower surface 162 of lid 150 is bought into contact with or adjacent to upper surface 132 of base 122; 2) output port 166 of lid 150 is aligned with and brought into close proximity with input port 140 in base 122; and 3) input port 170 of lid 150 is aligned with and brought into close proximity with output port 144 of base 122. Once cell culture media 188 establishes fluid contact with the content of channel 136, cells 190 in cell culture media 188 diffuse into the predetermined fluid in channel 136.

Figure 7:
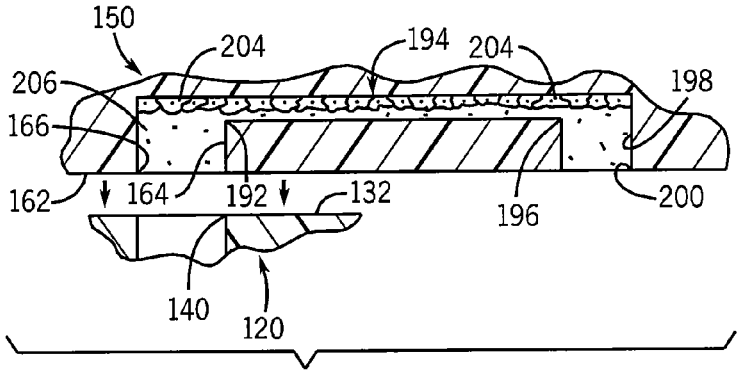
FIG. 7 is an enlarged, cross sectional view showing an alternate embodiment of a lid for the microfluidic device of the present invention in a non-actuated position.

As best seen in FIG. 7, first well 164 in lid 150 may be in communication with first end 192 of channel 194 extending through lid 150. Second end 196 of channel 194 communicates with loading well 198 which terminates at input 200. Input 200 of loading well 198 communicates with lower surface 162 of lid 150. It is contemplated for the absolute value of the radius of curvature of output port 166 to be greater than the absolute value of the radius of curvature of input 200 such that the pressure at output port 166 is essentially zero. As a drop is deposited on input 200, a pressure gradient is generated so as to cause the drop to flow from input 200 through channel 194 to output port 166. It can be understood that by sequentially depositing additional drops on input 200, the resulting pressure gradient will cause the drops to flow to output port 166 thereby generating fluid flow from input 200 to output port 166. It can be appreciated that using the methodology heretofore described, cells 204 may be flowed into and cultured within cell culture media 206 in channel 194.

With cells 204 cultured in channel 194, lid 150 may be positioned on base 122, as heretofore described, such that: 1) lower surface 162 of lid 150 is bought into contact with or adjacent to upper surface 132 of base 122; 2) output port 166 of lid 150 is aligned with and brought into close proximity with input port 140 in base 122; and 3) input port 170 of lid 150 is aligned with and brought into close proximity with output port 144 of base 122. Once cell culture media 206 establishes fluid contact with the content of channel 136, cells 204 in channel 194 diffuse into the predetermined fluid in channel 136.

Referring to FIG. 8, in order to facilitate fluid flow in channel 136, it is contemplated to provide absorbent 220 in second well 168. It can be appreciated that with lid 150 positioned on base 122 as heretofore described, absorbent 220 contacts the predetermined fluid in channel 136 at output port 144 such that fluid flow within channel 136 is induced. Alternatively, in order to induct fluid flow in channel 136, absorbent 220 in second well 168 may be removed and an input of capillary 222 may be provided in communication with second well 168, FIG. 9. The output of capillary 222 is operatively connected to a pumping mechanism (not shown).

In operation, lid 150 is positioned on base 122, as heretofore described, such that: 1) lower surface 162 of lid 150 is bought into contact with or adjacent to upper surface 132 of base 122; 2) output port 166 of lid 150 is aligned with and brought into close proximity with input port 140 in base 122;

and 3) input port 170 of lid 150 is aligned with and brought into close proximity with output port 144 of base 122. As lid 150 is positioned on base 122, it is contemplated for post 145 projecting from upper surface 132 of base 122 to be received into first well 164 through output port 166. It can be appreciated that as post 145 engages membrane 186 and urges membrane 186 into first well 164, the fluid therein is urged from first well 164 through hole 187; through channel 136, output port 144 and second well 168 in lid 150; and into the input of capillary 222. Thereafter, the predetermined fluid in communication with the input of capillary 222 initiates the pumping mechanism to maintain fluid flow in channel 136. It can be appreciated that first vertical portion 138 of channel 136 in base 122 acts as a collection funnel to capture the fluid received from first well 164 in lid 150.

An additional contemplated application of the present invention is to provide a kit incorporating microfluidic device 10 wherein an end user can place biomaterial of choice (cells, tissues, etc) in channel 136 of base 122. A series of lids may be provided in the kit for acting on the biomaterial in channel 136. For example, the series of lids may be used for a variety of purposes, such as gradient chemotaxis; to contain the biomaterial; and/or for drug treatment. After the end user manipulates the biomaterial as desired, a series of additional lids may be provided that allow the end user to complete an entire immunostaining protocol without the need for pipettes. These lids would contain liquids, including the antibodies and fluorophores, needed for detection. The end user would effectuate the protocol by applying the lids, as heretofore described, in a specified sequence. This application allows for higher throughput, cheaper costs, and faster protocol times.

Microfluidic device 120 maybe also be used to study leukocyte adhesion. As is known, leukocyte adhesion is critical for proper immune responses to sites of wound or infection. Too much or too little adhesion is a hallmark for a variety of pathologies including leukocyte adhesion deficiency (LAD) and vasculitis. The current methods for adhesion assay require the use of multi-well plates coated with a substrate in which a patient's purified white blood cells are applied in large quantities. The cells are stimulated to adhere for period of time, and then a series of washes using large volumes and pipettes is performed to monitor the strength of cell adhesion. Using microfluidic device of the present invention, a platform is provided in which small cell quantities could be used and purified in the single device. By way of example, a series of lids 150 containing the necessary wash buffers may be sequentially applied to small cell quantities in channel 136 of base 122 of microfluidic device 120, as heretofore described. Thereafter, an end user could sequentially apply additional lids 150 to perform the adhesion assay. This would provide increased efficiency and decreased sample volumes, an attractive requisite for blood samples.

Various modes of carrying out the invention are contemplated as being within the scope of the following claims particularly pointing out and distinctly claiming the subject matter that is regarded as the invention.

The invention claimed is:

1. A microfluidic device for handheld diagnostics and assays, comprising:

a base having:

a planer outer surface and a channel extending through an interior of the base for receiving fluid therein, the channel including:

a main portion having input and output ends and being entirely within the base at a location spaced from the outer surface;

an input portion including a first end communicating with the outer surface of the base and a second end communicating with the input end of the main portion of the channel; and an output portion spaced from the input portion and including a first end communicating with the outer surface of the base and a second end communicating with the output end of the main portion of the channel;

a lid having a planer outer surface, a first well having a first port communicating with the outer surface of the lid, and a second well spaced from the first well and having a second port communicating with the outer surface of the lid, the lid moveable between a first disengaged position wherein the lid is spaced from the base and a second engaged position wherein the first port of the lid is axially aligned with and adjacent to the input portion of the channel and the second port of the lid is axially aligned with and adjacent to the output portion of the channel;

a substance received in the first well of the lid; and a post projecting from the planar outer surface of the base and being fixed at a location adjacent to the first end of the input portion of the channel, the post configured for receipt in the first well of the lid with the lid in the engaged position; and wherein with the lid in the engaged position, the post urges the substance from the first well of the lid into the first end of the input portion of the channel such that the substance flows from the first well through the input portion into the main portion of the channel and toward the output portion of the channel.

2. A microfluidic device for handheld diagnostics and assays, comprising:

a base having:

a planer outer surface and a channel extending through an interior of the base for receiving fluid therein, the channel including:

a main portion having input and output ends and being entirely within the base at a location spaced from the outer surface;

an input portion including a first end communicating with the outer surface of the base and a second end communicating with the input end of the main portion of the channel; and an output portion spaced from the input portion and including a first end communicating with the outer surface of the base and a second end communicating with the output end of the main portion of the channel;

a lid having a planer outer surface, a first well having a first port communicating with the outer surface of the lid, and a second well spaced from the first well and having a second port communicating with the outer surface of the lid, the lid moveable between a first disengaged position wherein the lid is spaced from the base and a second engaged position wherein the first port of the lid is axially aligned with and adjacent to the input portion of the channel and the second port of the lid is axially aligned with and adjacent to the output portion of the channel;

a substance received in the first well of the lid;

a membrane extending over the first port of the first well of the lid; and a plunger receivable in the lid and a needle extending from the plunger, the plunger moveable between a first retracted position and a second extended position wherein the needle pierces the membrane.

3. The microfluidic device of claim 2, wherein the needle has a terminal end, the needle moveable from a first retracted position wherein the terminal end of the needle is received in the first well in the lid and a second extended position wherein the terminal end of the needle projects from the lid in response to the movement of the plunger from the first retracted position and the second extended position.

4. The microfluidic device of claim 1, further comprising a fluid absorbent receivable in the second well of the lid, the fluid absorbent communicating with fluid in the channel of the base with the lid in the engaged position.

5. The microfluidic device of claim 1, further comprising a substance source receivable in the first well of the lid, the substance source including a substance for diffusing into fluid in the channel of the base with the lid in the engaged position.

6. The microfluidic device of claim 5, wherein the substance source includes a porous media housing the substance.

7. A microfluidic device for handheld diagnostics and assays, comprising:

a base having a planar outer surface and a channel therethough for receiving fluid therein, the channel including:

a main portion having input and output ends and being entirely received within the base at a location spaced from the outer surface;

an input portion including a first end communicating with the outer surface of the base and a second end communicating with the input end of the main portion of the channel; and an output portion spaced from the input portion and including a first end communicating with the outer surface of the base and a second end communicating with the output end of the main portion of the channel;

a lid having an outer surface and being connectable to the base, the lid including a first well having an interior and a first port communicating with the outer surface of the lid and a second well having a second port communicating with the outer surface;

a substance received in the first well of the lid; and a membrane extending over the first port of the first well for isolating the interior thereof;

a plunger receiveable in the lid and a needle extending from the plunger, the plunger moveable between a first retracted position and a second extended position wherein the needle pierces the membrane so as to allow the substance to flow from the first well; and wherein:

the lid moveable between a first disconnected position wherein the lid is spaced from the base and a second connected position wherein the first port of the lid is adjacent the input portion of the channel and the second port is adjacent the output portion of the channel.

8. The microfluidic device of claim 7, wherein the needle has a terminal end, the needle moveable from a first retracted wherein the terminal end of the needle is received in the first well in the lid and a second extended position wherein the terminal end of the needle projects from the lid in response to the movement of the plunger from the first retracted position and the second extended position.

9. The microfluidic device of claim 7, further comprising a fluid absorbent receivable in the second well of the lid, the fluid absorbent communicating with fluid in the channel of the base with the lid in the second connected position.

10. The microfluidic device of claim 7, further comprising a substance source receivable in the first well of the lid, the substance source including a substance for diffusing into fluid in the channel of the base with the lid in the connected position.

11. The microfluidic device of claim 10, wherein the substance source includes a porous media housing the substance.

12. A microfluidic device for handheld diagnostics and assays, comprising:

a base having a planar outer surface and a channel therethough for receiving fluid therein, the channel including:

a main portion having input and output ends and being entirely received within the base at a location spaced from the outer surface;

an input portion including a first end communicating with the outer surface of the base and a second end communicating with the input end of the main portion of the channel; and an output portion spaced from the input portion and including a first end communicating with the outer surface of the base and a second end communicating with the output end of the main portion of the channel;

a lid having an outer surface and being connectable to the base, the lid:

including a first well having an interior and a first port communicating with the outer surface of the lid and a second well having a second port communicating with the outer surface; and being moveable between a first disengaged position wherein the lid is spaced from the base and a second engaged position wherein the first port of the lid is axially aligned with and adjacent to the input portion of the channel and the second port of the lid is axially aligned with and adjacent to the output portion of the channel;

a substance received in the first well of the lid; and a post projecting from the planar outer surface of the base and being fixed at a location adjacent to the first end of the input portion of the channel, the post being receivable in the first well of the lid with the lid in the engaged position so as to cause the substance received in the first well of the lid to sequentially flow from the first well through the input portion of the channel into the main portion of the channel wherein the substance flows toward the output portion of the main channel.

* * * * *